United States Patent [19]

Miller

[11] Patent Number: 4,802,976

[45] Date of Patent: Feb. 7, 1989

[54] METHOD FOR RECOVERING FINE CLEAN COAL

[76] Inventor: Francis G. Miller, P.O. Box 501, Ligonier, Pa. 15658

[21] Appl. No.: 140,564

[22] Filed: Jan. 4, 1988

[51] Int. Cl.[4] ..... B03B 7/00; B03B 9/00; B03D 1/02

[52] U.S. Cl. ..... 209/12; 209/39; 209/17; 209/211; 209/172.5; 209/166; 44/627

[58] Field of Search ..... 209/164, 166, 167, 17, 209/211, 172.5, 3, 12, 39; 44/621, 622, 623, 624, 625, 627

[56] References Cited

U.S. PATENT DOCUMENTS

| | | | |
|---|---|---|---|
| 2,430,762 | 11/1947 | Erck | 209/172.5 |
| 2,460,802 | 2/1949 | Bitzer | 209/172.5 |
| 2,468,005 | 4/1949 | Walker | 209/172.5 |
| 2,623,637 | 12/1952 | Fontein | 209/172.5 |
| 3,638,791 | 2/1972 | Harrison | 209/172.5 |
| 3,687,284 | 8/1972 | Leeman | 209/172.5 |
| 3,696,923 | 10/1972 | Miller | 209/12 |
| 3,794,162 | 2/1974 | Miller | 209/172.5 |
| 4,140,628 | 2/1979 | Hors fall | 209/172.5 |
| 4,144,164 | 3/1979 | Absil | 209/172.5 |
| 4,505,812 | 3/1985 | Lees | 209/275 |

FOREIGN PATENT DOCUMENTS

| | | | |
|---|---|---|---|
| 506108 | 3/1946 | Canada | 209/164 |
| 504614 | 3/1947 | Canada | 209/164 |

*Primary Examiner*—Kenneth M. Schor
*Assistant Examiner*—Thomas M. Lithgow
*Attorney, Agent, or Firm*—John S. Simitz

[57] ABSTRACT

A heavy medium low-specific gravity method for recovering coarse clean coal within a size range of about +28 m and fine clean coal and coal-bearing particles within a size range of −28 x Om from a raw coal feed wherein heavy medium is recovered as a substantially clean product which can be recycled in the heavy medium system. In the method a raw coal feed containing coal, shale and other impurities within a size range of about 3.81 cm×0 is mixed withi a heavy medium to produce a slurry of low specific gravity between about 1.27 and 1.70. The slurry is treated in at least one cyclone to separate an overflow product containing substantially all coal and coal-bearing particles from an underflow product containing all shale and sulfur-bearing rejects.

The overflow product is treated on standard equipment to separate coarse coal from fine coal and heavy medium. The coarse coal is recovered as a usable product. The fine coal and heavy medium are separated from each other in a froth-flotation cell wherein fine coal is separated from the heavy medium and is recovered as a usable product. The substantially clean heavy medium is suitable for recycling to the heavy medium low specific gravity system.

The cyclone underflow product is also treated on similar equipment to separate the coarse shale from fine coal, coal-bearing particles, fine shale and heavy medium. The coarse shale is wasted. The fine coal, coal-bearing particles, fine shale and heavy medium are separated from each other in a froth-flotation cell. The fine coal and coal-bearing particles are separated from the medium and fine shale and are recovered as a usable product. The substantially clean heavy medium is suitable for recycling to the heavy medium low specific gravity coal recovery system.

2 Claims, 1 Drawing Sheet

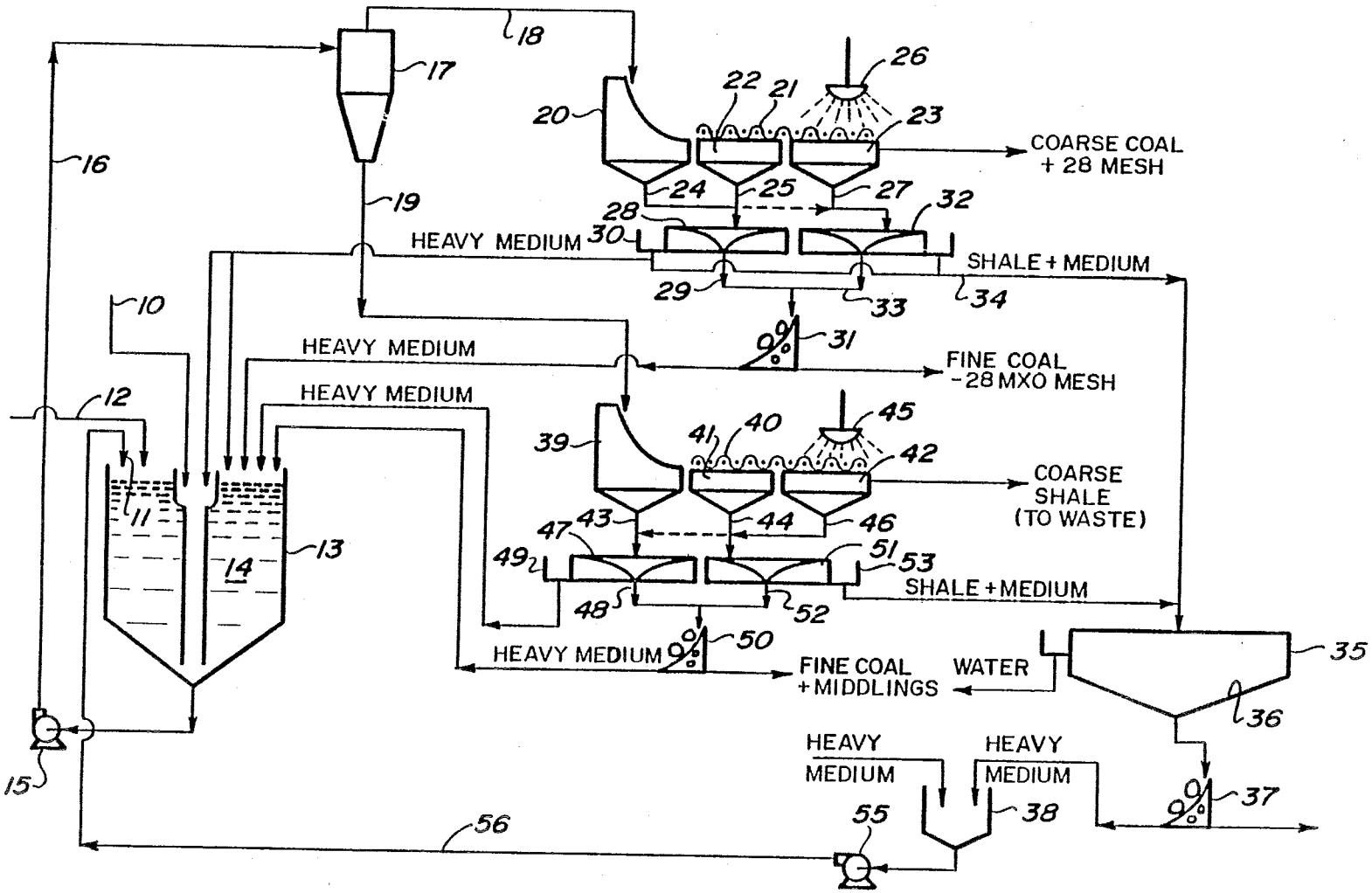
COARSE COAL + 28 MESH
SHALE + MEDIUM
FINE COAL -28 MXO MESH
COARSE SHALE (TO WASTE)
SHALE + MEDIUM
WATER
HEAVY MEDIUM
FINE COAL + MIDDLINGS
HEAVY MEDIUM
HEAVY MEDIUM
HEAVY MEDIUM
HEAVY MEDIUM
HEAVY MEDIUM
10
11
12
13
14
15
16
17
18
19
20
21
22
23
24
25
26
27
28
29
30
31
32
33
34
35
36
37
38
39
40
41
42
43
44
45
46
47
48
49
50
51
52
53
55
56

METHOD FOR RECOVERING FINE CLEAN COAL

BACKGROUND OF THE INVENTION

This invention is directed to a heavy medium low specific gravity method for recovering coarse clean coal within a size range of +28 m and fine clean low specific gravity, low sulfur coal and coal-bearing particles within a size range of −28×0 m from a raw coal feed having a size range of about 3.81 cm×0 and to recover a substantially clean heavy medium which is reusable in the heavy medium low specific gravity system.

It is well-known in the art that coarse clean coal, for example coal having a size of +1.0 mm, can be separated from shale, pyrite, and other impurities in a raw coal feed and can be recovered as a usable product by heavy medium low specific gravity systems using cyclones and screens. When such raw coal feed is cycloned, the constituents in the feed are separated into an overflow fraction containing the relatively light constituents, for example coal and coal-containing particles and an underflow fraction containing the relatively heavier constituents, for example shale and heavy medium. There is little problem in separating the particles in either the overflow and underflow from the heavy medium by screening. However, when the size of the particles becomes smaller, for example less than about 1.0 mm, the separation of the particles becomes progressively more difficult. It is virtually impossible to effect separation of the particles by screening when the particle size is less than about 100 mesh (0.15 mm). Since the requirements for coal quality, i.e., sulfur content is becoming more stringent and the reserves of high grade low sulfur coal are being depleted, there is more emphasis being placed on the development of more efficient heavy medium systems to produce usable coal from all grades and finer sizes of coal.

Several prior art methods to alleviate the above-mentioned problems have been suggested. Indicative of such methods is U.S. Pat. No. 4,140,628 issued Feb. 20, 1979 to David W. Horsfall entitled "Dense Medium Separation". The heavy medium system described by Horsfall is directed to recovering coal which is less than 1000 microns and particularly to coal which is less than 500 microns in size. The patent coal within a size range of 1000 microns is "recalcitrant to separation techniques such as froth-flotation" hence, dense medium separation in a series of cyclones is required. It is obvious that the teaching of Horsfall is directed away from the separation of fine coal and heavy medium by the use of froth-flotation.

U.S. Pat. No. 3,696,923 issued Oct. 10, 1972 to Francis G. Miller entitled "Method for Recovering Fine Coal and Coal-Containing Particles in a Coal Recovery Circuit" teaches that froth-flotation techniques can be used to separate coal from shale in water systems only but not in heavy medium systems.

U.S. Pat. No. 3,794,162 issued Feb. 26, 1974 to Francis G. Miller, et al. and entitled "Heavy Medium Beneficiating Process" teaches the recovery of coarse coal within a size range of 28×150 mesh from a raw coal feed in a heavy medium system using magnetite ore as the heavy medium. In the process of the invention, the raw coal to be treated is screened to remove all particles below about 150 mesh prior to combining the raw coal with the heavy medium. Miller, et al. teach that coal particles in the size range of −28×0 mesh must be removed from the slurry prior to treatment in a heavy medium system. Hence they do not teach a system which incorporates froth-flotation to recover such fine low sulfur coal, coal-bearing particles and substantially clean heavy medium suitable for reuse in the heavy medium low specific gravity system.

U.S. Pat. No. 2,623,637 issued Dec. 20, 1952 to F. J. Fontein of coal from shale in a raw coal feed in a heavy medium system using cyclones and vibratory screens. The heavy medium is separated from other particles by magnetic separation, hence the heavy medium must be demagnetized prior to reuse in the system. Fontein teaches the use of a series if specially designed cyclones in a plurality of steps to separate the smaller sizes of materials. His teaching is void of the separation of fine coal and coal-bearing particles within a size range of −28×0 m and heavy medium in a froth-flotation step wherein the heavy medium is cleaned sufficiently for reuse in the heavy medium low specific gravity systems.

No one nor any combination of the prior art practices shown above teach a heavy medium low specific gravity method in combination with froth-flotation steps wherein coarse coal having a size range of +28 m, fine coal and coal-bearing particles having a size range of −28×0 m can be recovered as usable products from a raw coal feed having a particle size range of about 3.81 cm×0 and that the heavy medium thus recovered is a substantially clean product suitable for reuse in the heavy medium low specific gravity system. The problems of poor efficiency of coal recovery and the recycling of contaminated heavy medium are thus alleviated.

It is, therefore, the object of this invention to provide a heavy medium low specific gravity method for treating a raw coal feed containing particles within a size range of about 3.81 cm×0 wherein coarse coal within the size range of +28 m is recovered as a usable product and the heavy medium is reclaimed as a substantially clean product which can be recycled in the heavy medium low specific gravity system.

It is another object of this invention to provide a heavy medium low specific gravity method for treating a raw coal feed containing particles within a size range of 3.81 cm×0 wherein fine gravity low sulfur coal and low sulfur coal-bearing particles within the size range of −28×0 m are recovered as usable products and the heavy medium is reclaimed as a substantially relatively clean product in a froth-flotation separation step.

It is also an object of this invention to provide a method for recovering substantially clean heavy medium for reuse in a heavy medium low specific gravity system.

FIGURE OF THE INVENTION

The drawing is a schematic of a heavy medium low specific gravity system useful in the method of the invention.

Turning now to the drawing of the invention, a raw coal feed 10 containing coarse coal, fine coal and coal-containing particles and impurities, hereinafter for example pyrite, sulfur-bearing particles and shale which in these specifications are included in the general definition of shale, within a size range of 3.81 cm×0 a heavy medium 11, for example magnetite ore, ferrosilicon and/or mixtures thereof and water 12 are fed to sump 13. The materials are mixed in the sump 13 to form a relatively uniform slurry 14. The slurry 14 is pumped by pump 15 through pipe 16 to at least one cyclone 17. The slurry 14 is separated into a cyclone overflow product 18 and a cyclone underflow product 19. The separation of from the impurities in the raw coal feed is dependent upon the specific gravity of the slurry. The raw coal feed contains coal and coal-containing particles having a specific gravity of between about 1.27 to about 1.70, shale having a specific gravity of about not less than 1.70 and pyrite having a specific gravity which may be as high as 4.0. The specific gravity of the slurry is controlled by adding varying amounts of medium to the slurry so that separations can be made at a specific gravity as low as 1.27 and as high as 1.70 dependent upon the product desired. Separations at these specific gravities are sharp when heavy medium such as magnetite ore and ferrosilicon and/or mixtures thereof are used to control the specific gravity. At a specific gravity of 1.27 the cyclone overflow will contain substantially all the particles in the slurry which have a specific gravity of not more than about 1.27 and the cyclone underflow will contain substantially all the particles having a specific gravity of not less than about 1.27. Likewise, at a specific gravity of 1.70 the cyclone overflow will contain substantially all the particles which have a specific gravity of not more than about 1.70 and the cyclone underflow will contain substantially all the particles having a specific gravity not less than about 1.70. In each case, substantially all the particles which are less than the specific gravity of the slurry are located in the cyclone overflow and all the particles which are greater than the specific gravity of the slurry are located in the cyclone underflow. Therefore, substantially all the coarse coal, fine coal and usually a major amount of the heavy medium appear in the cyclone overflow and substantially all the coarse shale, fine shale, the coal-bearing particles and the remainder of the heavy medium will appear in the underflow 19. As shown in the drawing, the cyclone overflow product 18 and the cyclone underflow product 19 are both subjected to particle size separations on identical equipment which may include sieve bends in tandem with vibrating screens having drain portions and rinse or wash portions. It is preferred to use fixed sieve bends which may or may not be rapped or vibrated, as the initial particle separating apparatus.

The cyclone overflow 18 is passed to a first sieve bend 20 in tandem with a first vibrating screen 21 having a drain portion 22 and a rinse portion 23 whereon substantially all the coarse coal having a size range of +28 mesh passes over the first sieve bend 20 and first vibrating screen 21 and is recovered as a coal product. Substantially all the fine coal having a size range of −28×0 mesh and substantially all the heavy medium fall through the openings in the first sieve bend 20 and the drain portion 22 and are collected as the first sieve bend undrrflow 24 and the drain portion underflow 25. The coarse coal is washed by water from water sprays 26 as it passes over the rinse portion 23. The water washes substantially all the fine coal and heavy medium which inadvertently remained on the surfaces of the coarse coal. The fine coal and medium thus washed from the surfaces of the coarse coal are collected as a dilute medium in a rinse portion underflow 27. The underflows 24 and 25 are combined to form a relatively dense slurry which is passed to at least one froth-flotation cell 28. Because the surfaces of the coal are hydrophobic the coal will float in the bubbles formed atop the slurry in the froth-flotation cell 28 to form a flotation-froth product 29. On the other hand, the surfaces of the heavy medium are hydrophilic and hence the heavy medium will remain suspended.in the slurry in the froth-flotation cell 28 and will be recovered as a first sink product 30. Flotation reagents, for example MIB (methyl iso-butyl carbinol) as noted in U.S. Pat. No. 3,696,923 issure Oct. 10, 1972 to Francis G. Miller entitled "Method for Recovering Fine Coal and Coal-Containing Particles in a Coal Recovery Circuit" and/or oil may be added to the froth-flotation cell 28 to aid in the production of the forth to improve the separation of the particles in the slurry. A substantially complete separation of fine coal and heavy medium is realized. The flotation-froth product 29 may contain fugitive particles of the heavy medium, therefore the first flotation-froth product 29 is passed to at least one magnetic separator 31 to separate the fine coal which is nonmagnetic from the heavy medium which is magnetic. The fine coal is recovered as a low specific gravity low sulfur product. The heavy medium which is substantially free of coal can be recycled to sump 13 for reuse in the heavy medium low specific gravity system.

The rinse portion underflow 27 contains relatively small amounts of fine coal and medium and a large volume of water, hence the underflow 27 is referred to as a dilute slurry or medium. The rinse portion underflow 27 is treated in at least one froth-flotation cell 32 to which at least one of the flotation reagents mentioned above may be added. The small amount of fine coal in the slurry floats in the froth atop the slurry and is recovered as flotation-froth product 33. The medium remains suspended in the slurry and is recovered as sink product 34. The flotation-froth product 33 may contain fugitive particles of medium therefore it is treated in the magnetic separator 31 to separate and recover the fine coal from the fugitive particles of heavy medium. The sink product 30, which may also be called tailings, contains a relatively small amount of medium in a large volume of water. Before this dilute medium can be reused in the heavy medium low specific gravity system, it must be concentrated. This is accomplished by passing it to a thickener 35 where it remains for a time sufficient to allow the medium to sink to the bottom 36. The water in the thickener 35 is clarified and can be reused in the heavy medium low specific gravity system. The medium is periodically removed from the bott and is passed to a magnetic separator 37 to recover the medium as a concentrated product which can be stored in sump 38 for reuse in the heavy medium low specific gravity system. Any nonmagnetic particles removed from the bottom 36 with the medium are passed to waste.

As noted previously, the cyclone underflow 19 which is substantially all coarse shale, fine shale and heavy medium and which may contain some fine coal and coal-bearing particles or middlings, is subjected to a particle size separation on a second sieve bend 39 in tandem with a second vibrating screen 40 having a drain portion 41 and a rinse portion 42. Substantially all the coarse shale passes over the sieve bend 39 and vibrating screen 40 and is wasted. Substantially all the water, fine coal and coal-bearing particles or middlings and heavy medium pass through openings in the second sieve bend 39 and are collected as a second sieve bend underflow 43. A second portion of water and fine coal and fine shale and heavy medium pass through openings in drain portion 40 and are collected as underflow 44. As the coarse shale passes over rinse portion 42, it is sprayed with water from sprays 45 to remove any fine coal, fine shale and medium which may have adhered to the surface of the coarse shale. The water, fine coal, fine shale and medium pass through the rinse portion 42 and are collected as an underflow 46. The second sieve bend underflow 43 which contains fine shale, fine coal, coal-bearing particles and heavy medium is passed to at least one froth-flotation cell 47 to which a frothing agent previously described may be added. The fine coal and coal-bearing particles float in the froth atop the slurry in the froth-flotation cell 47 and are recovered as a flotation-froth product 48. The fine shale and heavy medium remain suspended in the slurry and are recovered as a sink product 49. The flotation-froth product 48 is passed to a magnetic separator 50 to separate substantially all fine coal and coal-bearing particles as a nonmagnetic product from any fugitive medium as a magnetic product. The heavy medium is recycled to sump 13 for reuse in the heavy medium low specific gravity system.

All or a portion of the underflow 44 and all of the underflow 46 are combined and passed to at least one froth-flotation cell 51 wherein substantially all the fine coal and coal-bearing particles float in the froth atop the slurry and are recovered as a flotation-froth product 52. The medium and fine shale remain suspended in the slurry and are recovered as a sink product 53. At least one of the flotation reagents mentioned above may be added to the froth-flotation cell 51. The flotation-froth product 52 which is substantially all fine coal and coal-bearing particles may contain a small portion of fugitive heavy medium which is passed to the magnetic separator 50 to separate the fine coal and coal-bearing particles or middlings as a nonmagnetic product from the heavy medium as a magnetic product. The heavy medium is passed to sump 13 to be reused in the heavy medium low specific gravity system.

The sink product or tailings 53 which contains fine shale and dilute medium is combined with tailings 30 as feed to the static thickener 35 where they remain for a time sufficient to allow the shale and medium to sink to the bottom 36 thereby concentrating the medium and also providing a clarified water overflow which can be reused in the system. The settled particles are removed from the bottom 36 and are sent to magnetic separator 37 to separate the shale as a nonmagetic product from the heavy medium as a magnetic product. The fine shale is wasted. The heavy medium is stored in sump 38 for reuse in the heavy medium low specific gravity system. When needed in the system a portion of the heavy medium is pumped by pump 55 through pipe 56 to sump 13.

The heavy medium low specific gravity system in combination with froth-flotation as described in these specifications performs the function of making sharp low specific gravity separation of high grade coal from impurities in a raw coal feed and results in the recovery of high grade coal fines and coal bearing particles having a size range of $-28\times0$ mesh substantially clean heavy medium which is recyclable in the heavy medium low specific gravity system. Thus, the problems of wasting fine usable low specific gravity low sulfur coal and coal-bearing particles and the recycling of contaminated heavy medium in the heavy medium low specific gravity system are alleviated.

I claim:

1. In a heavy medium low specific gravity method for recovering coarse coal and fine coal and coal-bearing particles from a raw coal feed containing particles of coarse coal, fine coal, coal bearing particles, coarse shale and fine shale within a size range of 3.81 cm$\times$0 to which an amount of at least one heavy medium taken from the group consisting of magnetite ore and ferrosilicon is added to form a slurry having a specific gravity between about 1.27 and 1.70, which slurry is treated in at least one cyclone to separate substantially all the coarse coal, a substantial portion of the fine coal and a major amount of the heavy medium as a cyclone overflow from substantially all the coarse shale, the remaining portion of the fine coal, coal-bearing particles, fine shale and the remaining portion of the heavy medium as a cyclone underflow, treating the cyclone overflow on at least one sieve bend and vibrating screen to separate and recover all the coarse coal as a first screen overflow from the fine coal and heavy medium as a first screen underflow and treating the cyclone underflow on at least one sieve bend and one vibrating screen to separate substantially all the coarse shale as a second screen overflow from substantially all the fine coal, coal bearing particles, fine shale and heavy medium as a second screen underflow, the improvement comprising:

(a) treating the first screen underflow in at least one froth-flotation cell containing at least one flotation reagent taken from the group consisting of MIBC and oil to separate substantially all the fine coal as a first flotation froth product from substantially all the heavy medium as a first sink product.

(b) separating and recovering the fine coal from any fugitive heavy medium in the first flotation-froth product of step (a) in at least one magnetic separator, (c) recycling substantially clean heavy medium resulting from step (b) to the raw coal feed, (d) treating the second screen underflow in at least one froth-flotation cell containing at least one flotation reagent taken from the group consisting of MIBC and oil to separate substantially all the fine coal and coal-bearing particles as a second flotation-froth product from substantially all the heavy medium as a second sink product, (e) separating and recovering all the fine coal and coal-bearing particles from any fugitive heavy medium in the second flotation-froth product of step (d) in at least one magnetic separator, and (f) recycling the substantially clean heavy medium resulting from step (e) to the raw coal feed.

2. The method of claim 1 wherein the fine coal and coal-bearing particles recovered in steps (a) and (b) and (d) and (e) have a size within the range of $-28\times0$,

* * * * *